US008596330B2

(12) United States Patent
Slusarski et al.

(10) Patent No.: US 8,596,330 B2
(45) Date of Patent: Dec. 3, 2013

(54) LOW COST GARAGE DOOR LOCK

(75) Inventors: Ronald S Slusarski, Narrangasett, RI (US); Scott B Lowder, Orange, CT (US); Paul P Marquis, Wallingford, CT (US)

(73) Assignee: Sargent Manufacturing Company, New Haven, CT (US)

( * ) Notice: Subject to any disclaimer, the term of this patent is extended or adjusted under 35 U.S.C. 154(b) by 2146 days.

(21) Appl. No.: 11/003,296

(22) Filed: Dec. 3, 2004

(65) Prior Publication Data

US 2006/0118253 A1 Jun. 8, 2006

(51) Int. Cl.
*E05B 15/02* (2006.01)

(52) U.S. Cl.
USPC ..... 160/271; 292/341.16

(58) Field of Classification Search
USPC ..... 160/133, 201, 273.1, 290.1; 292/DIG. 36, 341.16, 341.15, 144, 150, 292/151, 148
See application file for complete search history.

(56) References Cited

U.S. PATENT DOCUMENTS

| | | | | | |
|---|---|---|---|---|---|
| 1,466,537 | A * | 8/1923 | McCarthy | 70/210 |
| 1,768,021 | A * | 6/1930 | Bauerband | 70/282 |
| 1,958,019 | A * | 5/1934 | Reasoner | 70/170 |
| 2,427,040 | A * | 9/1947 | Billman | 292/74 |
| 2,665,932 | A * | 1/1954 | Moler | 292/177 |
| 3,426,829 | A * | 2/1969 | McDaniel et al. | 160/201 |
| 3,638,461 | A * | 2/1972 | Watson | 70/92 |
| 3,751,086 | A * | 8/1973 | Geringer | 292/144 |
| 3,933,382 | A * | 1/1976 | Counts et al. | 292/144 |
| 4,254,582 | A * | 3/1981 | McGee | 49/199 |
| 4,345,448 | A * | 8/1982 | Solomon | 70/95 |
| 4,497,515 | A * | 2/1985 | Appelson | 296/141 |
| 4,615,548 | A * | 10/1986 | McGee | 292/144 |
| 4,659,121 | A * | 4/1987 | McGee | 292/144 |
| 4,697,442 | A * | 10/1987 | Stendal | 70/97 |
| 4,784,415 | A * | 11/1988 | Malaval | 292/144 |
| 4,819,379 | A * | 4/1989 | Kenzelmann et al. | 49/280 |
| 4,930,563 | A * | 6/1990 | Finch et al. | 160/271 |
| 5,533,561 | A * | 7/1996 | Forehand, IV | 160/188 |
| 5,593,192 | A * | 1/1997 | Stuchinsky | 292/207 |
| 6,401,793 | B1 * | 6/2002 | Martin | 160/191 |
| D470,033 | S | 2/2003 | Fleury et al. | |
| 6,719,334 | B1 * | 4/2004 | Curtis | 292/281 |
| 6,834,464 | B2 * | 12/2004 | Shoemaker | 49/449 |
| 6,893,060 | B2 * | 5/2005 | Ng | 292/251.5 |

OTHER PUBLICATIONS

*Locknetics. CM Computer Manages Electronic Locking Systems*. IR Security & Safety Catalog—2000, pp. 2-3.
*Locknetics. When Life Safety+Security Matter*. Locknetics Security Engineering Catalog—Feb. 1998, pp. 10-26.
*V Series, Stand-Alone Electronic Locks*. Best Access Systems Catalog—Jul. 1998, pp. 2-11.
Photograph and line drawing of DBCI mini lock.

* cited by examiner

*Primary Examiner* — David Purol
(74) *Attorney, Agent, or Firm* — DeLio & Peterson, LLC

(57) ABSTRACT

A vertical door locking system includes a sliding latch mounted to a door that opens vertically, such as a garage door or corrugated self-storage door, and an electrically operated solenoid mounted at a fixed location on a guide rail for the door or the door frame. The latch includes a latchbolt that extends outward from the door to prevent the door from being raised vertically and the latchbolt has an opening at one end. The solenoid includes a spring operated solenoid rod that extends into the opening in the latchbolt to prevent the latchbolt from being retracted thereby preventing the door from being opened unless the solenoid is electrically operated to disengage the solenoid rod and release the latchbolt.

20 Claims, 4 Drawing Sheets

LOW COST GARAGE DOOR LOCK

BACKGROUND OF THE INVENTION

1. Field of the Invention

The present invention relates to locks for doors that open vertically, such as garage doors, rollup doors and overhead doors. More specifically, the present invention relates to electrically controlled locks for vertical doors.

2. Description of Related Art

Doors that open vertically are widely used in self-storage centers, as garage doors and as loading and access doors. Vertical doors include various types of vertically sliding and rollup doors that are typically provided with horizontal corrugations allowing the door to bend to a horizontal position or form a horizontal roll above the door opening.

A typical method of locking vertical doors in self-storage installations uses a latch attached to the vertical door. The latch includes a sliding latchbolt that extends horizontally outward from the side of the vertical door and through the adjacent vertical door guide or doorframe. When extended, the latchbolt prevents the door from being lifted. To prevent the latch from being withdrawn, a key operated padlock is typically attached between the body of the latch and the latchbolt, holding the latchbolt in the latched position.

To remove the padlock, the self-storage customer is provided with a key. When the key is lost, or the storage area is rented to another customer, the key must be replaced and/or the lock must be changed. This represents an ongoing problem due to both cost and the labor time required. Locks and keys must also be changed when a customer has failed to pay applicable storage fees.

These difficulties have created a demand for electrically controlled vertical door locks. Such locks may be operated by a keypad, a magnetic stripe card, an RFID tag that sends a coded signal when proximate an RFID reader or by other electrically based security systems. Although sophisticated electrically controlled locks may be modified for vertical door use, there exists a need for a low cost electrically controlled lock for vertical doors.

One design difficulty in electrifying the simple mechanically operated sliding latchbolt design described above is that the latch mechanism and lock are attached to the vertical door. The vertical motion of the door makes it difficult and expensive to supply electrical power to a latch mechanism that must move whenever the door is opened or closed.

Bearing in mind the problems and deficiencies of the prior art, it is therefore an object of the present invention to provide a low cost, simple and reliable vertical door locking system that electronically controls access to a secure area.

Another object of the present invention is to provide a vertical door locking system that can be installed on existing vertical doors having conventional mechanically operated sliding latches of the type described above.

Yet another object of the present invention is to provide a vertical door locking system that is electrically operated but requires no electrical connection to the portion of the lock on the moving vertical door.

Still other objects and advantages of the invention will in part be obvious and will in part be apparent from the specification.

SUMMARY OF THE INVENTION

The above and other objects, which will be apparent to those skilled in art, are achieved in the present invention which is directed to a vertical door locking system including an electrically operable solenoid and a latch. The solenoid includes a solenoid rod movable between an extended position and a retracted position. The latch includes a latchbolt with an opening at an end thereof of sufficient size to receive the solenoid rod and the latchbolt is movable between a latched position and an unlatched position.

The latch is mounted on the vertical door to be locked. The solenoid is mounted on a solenoid mount at a fixed location near the edge of the door. When the latchbolt is in the latched position it prevents the door from opening. The solenoid mount holds the solenoid with the solenoid rod extending perpendicular to the latchbolt. The solenoid rod prevents the latchbolt from moving to the unlatched position when the solenoid rod is in the extended position and received in the opening in the end of the latchbolt.

The latchbolt is preferably of the manually slidable type and includes a latch body for mounting the latchbolt on the door. The latchbolt is slidably held by the latch body which is preferably specially shaped to mount the latchbolt on a corrugated surface of a vertical door.

The solenoid rod is spring operated and the end of the latchbolt and the solenoid rod are shaped to cooperatively interact and drive the solenoid rod towards the retracted position as the latchbolt is moved from the unlatched to the latched position. The spring operated solenoid rod thereafter returns to the extended position and engages the opening in the end of the latchbolt as the latchbolt reaches the latched position.

The cooperative interaction may be provided by a bevel on the end of the latchbolt, a rounded end on the solenoid rod, or by providing both features or other angled elements to drive the solenoid rod towards the retracted position as the latchbolt is moved from the unlatched to the latched position.

The solenoid rod is preferably manually movable to the retracted position to permit the door to be unlocked from inside without electrical power. In the preferred design, the solenoid rod includes a knob at an end thereof whereby the solenoid rod may be manually moved to the retracted position against spring biasing pressure provided by the solenoid.

The solenoid mount is preferably adapted for mounting to a guide rail for the vertically opening door. The solenoid mount also preferably includes a latchbolt opening for receiving the latchbolt, the latchbolt opening being shaped to steer the latchbolt into a desired alignment relative to the solenoid and the solenoid rod as the latchbolt moves to the latched position.

In another aspect of the invention, the solenoid rod is weakened to permit the solenoid rod to break when an excess force is applied to the latchbolt whereby the latchbolt may be moved to the unlatched position by breaking the solenoid rod in the event the solenoid fails to operate electrically.

The invention also includes a vertical door and vertical door locking system including a vertically opening door, a guide rail having a latchbolt opening, the guide rail acting to vertically guide the door between opened and closed positions, an electrically operable solenoid having a solenoid rod moveable between an extended position and a retracted position, a latch and a solenoid mount. The latch is adapted for attachment to the door and includes a latchbolt movable between a latched position to prevent the door from opening and an unlatched position to allow the door to open. The latchbolt has an opening at an end thereof of sufficient size to receive the solenoid rod and the latchbolt extends through the latchbolt opening when the door is in the closed position and the latchbolt is in the latched position. The solenoid mount is attached to the guide rail near the latchbolt opening and holds the solenoid with the solenoid rod extending perpendicular to the latchbolt. The solenoid rod prevents the latchbolt from moving to the unlatched position when the solenoid rod is in the extended position and received in the opening in the end of the latchbolt.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4 of the drawings in which like numerals refer to like features of the invention.

Figure 1:
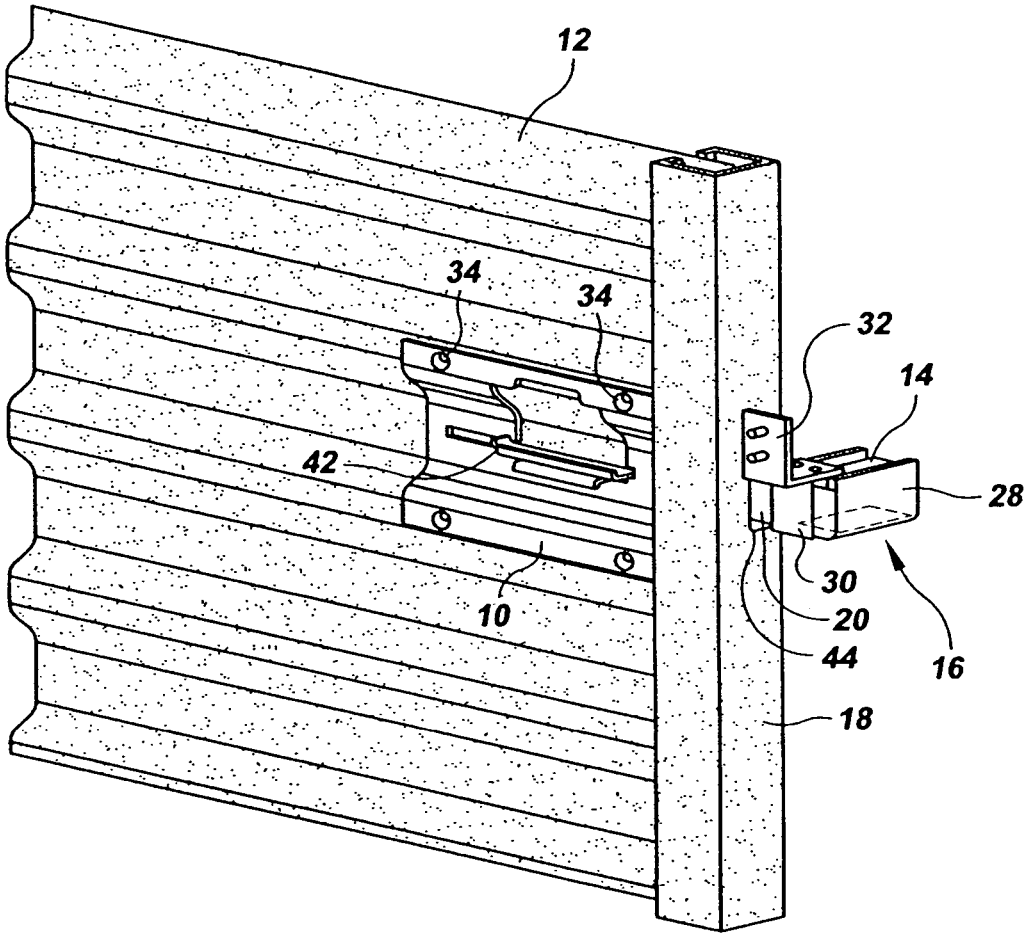
FIG. 1 is a perspective view of a vertical door locking system according to the present invention. The locking system is shown from the front side of the door as installed on a corrugated vertical door, and only a portion of the vertical door and a portion of a guide rail for the vertical door are illustrated.
Figure 2:
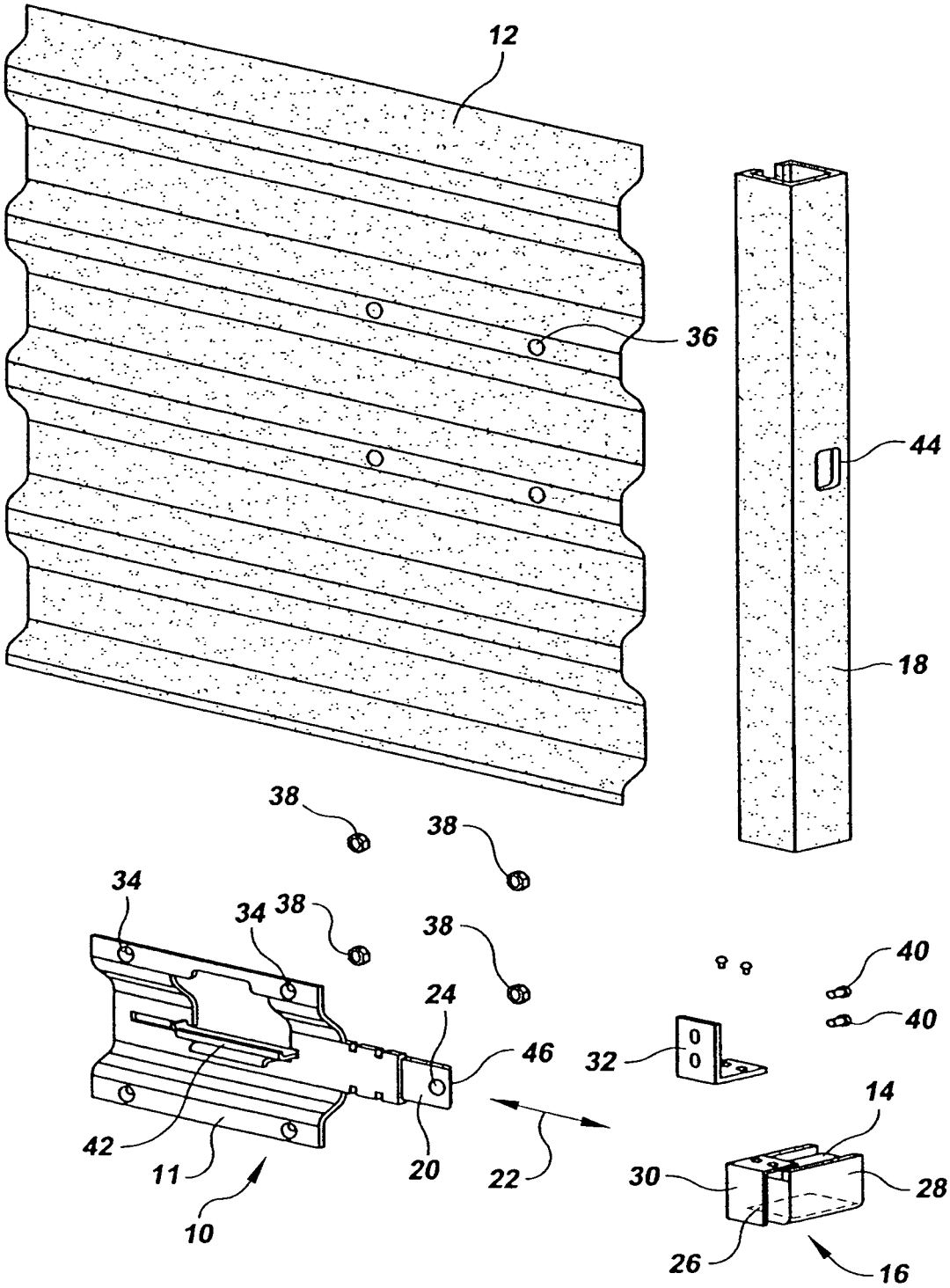
FIG. 2 is an exploded perspective view of the vertical door locking system in FIG. 1.
Figure 3:
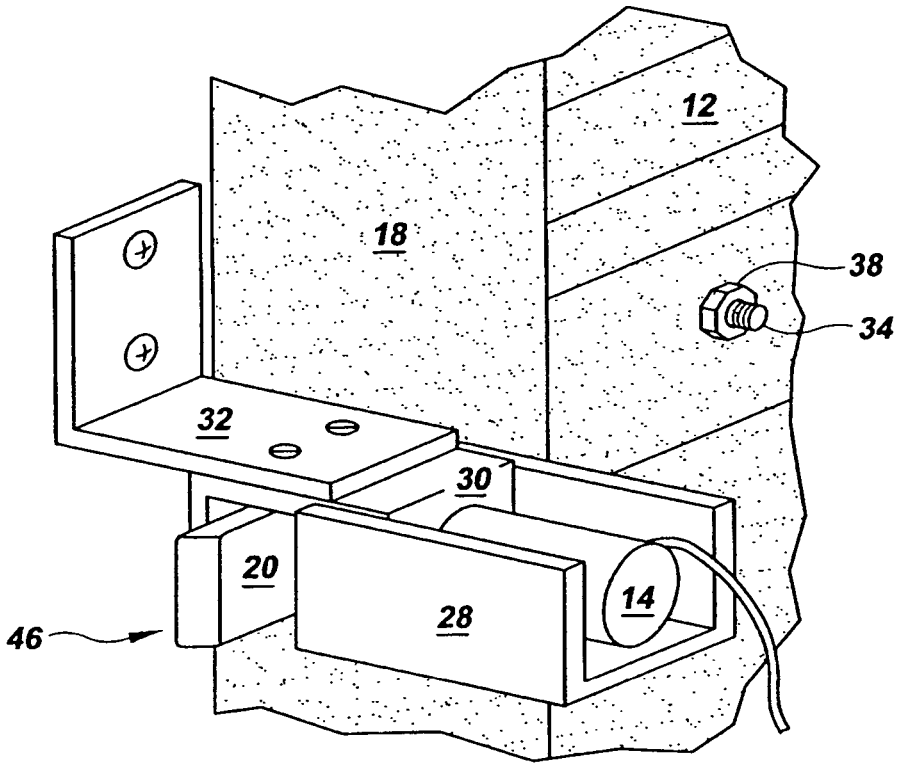
FIG. 3 is a detail perspective view of the vertical door locking system in FIG. 1. This view shows the solenoid, solenoid mount and a portion of the extended latchbolt as they appear from the backside of the door.

Referring to FIGS. 1-3, the present invention includes a latch 10 and a solenoid 14. When latched, the latch functions to prevent vertical door 12 from opening and the solenoid functions to prevent the latch from being unlatched until the solenoid is electrically operated. The latch is directly mounted on, and moves with, the vertical door 12 as it is opened and closed. The solenoid 14 is held in a fixed position by solenoid mount 16, which may be attached to vertical door guide 18 or to the wall, doorframe or other support adjacent to the edge of the vertical door.

As may be seen in the exploded view in FIG. 2, the latch 10 includes a latchbolt 20 which slides horizontally on a latch body 11. The latchbolt moves in the directions indicated by arrow 22 between an extended latched position (latchbolt to the right—as illustrated) and a retracted unlatched position (latchbolt to the left). The latchbolt 20 includes an opening 24 at the right end thereof sized to receive a solenoid rod 26 that extends perpendicularly outward from the solenoid 14.

In the design seen in FIGS. 1-3, the solenoid mount 16 comprises a pair of U-shaped brackets 28, 30 and an L-shaped bracket 32 which allow the solenoid to be mounted to an adjacent wall or doorframe. In the design seen in FIG. 4, however, the solenoid mount comprises a single U-shaped mount 16' attached directly to the guiderail 18.

As may be seen in FIG. 2, the body of the latch 10 is specially shaped to fit the horizontal corrugations found on the vertical door 12. The horizontal corrugations of the door allow the door to flex so that it may be rolled above the door opening or turned to a horizontal orientation above the enclosed space behind the door. The latch 10 is attached to the door 12 with four bolts 34.

The bolts 34, which are preferably carriage bolts, extend through corresponding holes 36 in the door 12 and are secured on the backside with nuts 38. See also FIG. 3. The bolt pattern provided by holes 36 preferably corresponds to existing installations of mechanically operated vertical door latches so that the electrically operated latch of the present invention may be retrofitted to installed vertical doors.

In the most highly preferred design of the invention, the latchbolt including opening 24 is a retrofit replacement for an existing latch design having a latchbolt without opening 24 so that only the latchbolt needs to be replaced and the solenoid and mount installed. The solenoid mount 16 seen in FIGS. 1-3 is attached with screws 40 to an adjacent wall. In the second embodiment seen in FIG. 4, solenoid mount 16' is directly attached to the guide rail 18.

The latch 10 includes a handle 42 connected to the latchbolt 20, which allows the user to slide the latchbolt between the unlatched position and the latched position. When the door 12 is closed, the latchbolt 20 is aligned with opening 44 in the guide rail 18. When the latchbolt 20 is then moved to the latched position, the end of the latchbolt 20 with the opening 24 extends through latchbolt opening 44 and thereby prevents the vertical door 12 from being raised and opened. When the latch handle 42 is moved to the left, the latchbolt 20 is moved to the unlatched position and the door 12 may be raised to permit access to the secured space.

The solenoid mount 16 holds the solenoid 14 with the solenoid rod 26 perpendicular to the latchbolt. When the vertical door is closed and the latchbolt is moved to the right, the latchbolt 20 extends through latchbolt opening 44 and opening 24 in the latchbolt 20 aligns with the solenoid rod 26. The solenoid is electrically operated and moves the solenoid rod 26 between extended (locked) and retracted (unlocked) positions.

When the solenoid rod 26 is extended it engages opening 24 in the latchbolt and prevents the latchbolt from being moved to the unlatched position. Upon receipt of an electrical control signal, the solenoid rod retracts and the latchbolt 20 is again free to move to the unlatched position so that the door 12 may be opened.

In the preferred design, the solenoid includes a spring that biases the solenoid rod towards the extended position. The tip of the solenoid rod is preferably rounded (see FIG. 4) and the end of the latchbolt 20 is provided with a bevel 46 (see FIG. 3). The bevel 46 on the latchbolt 20 and the rounded hemispherical shape of the end of the solenoid rod 26 cooperate to allow the latchbolt to be moved from the unlatched position to the latched position even when the solenoid rod is in the extended position.

With the door closed, but unlatched, and the solenoid unpowered, with the solenoid rod spring biased towards the extended position, the sliding latchbolt may be moved towards the latched position. As the latchbolt approaches the solenoid rod, the bevel 46 on the end of the latchbolt contacts the rounded end of the solenoid rod 26 and drives the spring biased solenoid rod towards the retracted position. This allows the latchbolt 20 to extend fully to the latched position without interference from the solenoid rod.

As opening 24 reaches alignment with the solenoid rod, the spring action of the solenoid returns the solenoid rod to the extended position and thereby locks the latch until the solenoid is energized again. This operation allows the vertical door to be closed and latched without requiring the solenoid to be electrically retracted during the locking operation.

Figure 4:
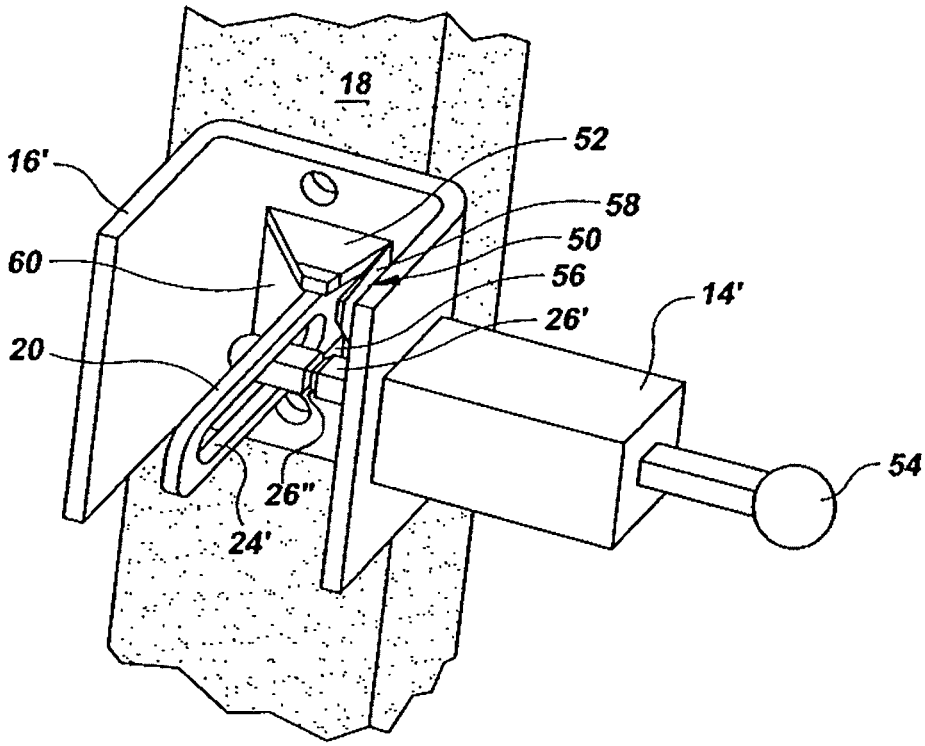
FIG. 4 is a detail perspective view of a second embodiment of the invention showing a modified solenoid and solenoid mount.

FIG. 4 illustrates a second embodiment of the invention. Opening 24 in the latchbolt has been enlarged to form an elongated slot 24'. This elongation allows the solenoid rod to engage the latchbolt in different installations without concern for accurate left/right horizontal alignment between the slot 24' and the solenoid rod 26', which has also been modified.

The solenoid rod 26' is weakened 26" to permit the solenoid rod 26' to break when an excess force is applied to the latchbolt 20 whereby the latchbolt may be moved to the unlatched position by breaking the solenoid rod in the event the solenoid fails to operate electrically.

In the design seen in FIG. 4, the solenoid mount 16' is formed from a single piece which reduces cost and parts count as compared to the solenoid mount 16 in FIGS. 1-3. The one piece solenoid mount 16' is directly mounted to the guide rail 18 which simplifies installation and reduces alignment problems. Another advantage of the solenoid mount 16' in FIG. 4 is the incorporation of an integral latchbolt opening 50 in the solenoid mount.

The latchbolt opening 50 is aligned with opening 44 in the guide rail 18 and includes at least one angled element 52 which acts to steer the latchbolt into a desired alignment relative to the solenoid and the solenoid rod as the latchbolt moves to the latched position. Angled element 52 is an integral piece of the latchbolt opening 50 and the solenoid mount 16' and is preferably formed by punching to provide an inwardly and downwardly angled guide surface.

As the latchbolt enters the latchbolt opening 50, angled element 52 located above the latchbolt contacts the top of the latchbolt and vertically guides the latchbolt down to ensure vertical alignment between opening 24' and the latchbolt rod 26'. In the preferred design, there is a second angled element 56 below the latchbolt to inwardly and upwardly guide the latchbolt. The two angled elements 52, 56 define up/down vertical alignment for the latchbolt.

In addition to the angled elements above and below the latchbolt, the preferred design includes corresponding inwardly angled elements 58, 60 on the left and right sides of the latchbolt. Inwardly angled elements 58, 60 define a front/back horizontal alignment for the latchbolt and ensure that the latchbolt will properly push the solenoid rod back as it is inserted and that the solenoid rod will fully engage and properly disengage from opening 24' in the latchbolt.

Another feature of the invention seen in FIG. 4 is knob 54 attached to an end of the latchbolt rod 26', which extends out the back of the solenoid 14'. Knob 54 allows the solenoid rod 16' to be manually retracted so that the vertical door may be manually unlocked from the back side of the door. This prevents anyone from being trapped within the secured area behind door 12. The knob 54 is simply pulled against the spring bias pressure of the solenoid to retract the solenoid rod and the latchbolt is manually moved to the unlatched position.

The solenoid may be operated by any type of electrical security system desired. Available systems include magnetic stripe card readers, biometric sensors, smart cards, proximity sensors, such as radio frequency ID tags and chips, wireless and wired network controls, keypad entry systems and the like.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A vertical door locking system for use with a vertically opening door comprising:

an electrically operable solenoid having a solenoid rod movable between an extended position and a retracted position;

a latch adapted for attachment to said vertically opening door, the latch including a latchbolt movable relative to the vertically opening door between a latched position to prevent the door from opening and an unlatched position to allow the vertically opening door to open, the latchbolt having an opening at an end thereof of sufficient size to receive the solenoid rod; and a solenoid mount holding the solenoid at a fixed location with the solenoid rod extending perpendicular to the latchbolt, the solenoid rod preventing the latchbolt from moving to the unlatched position when the solenoid rod is in the extended position and received in the opening in the end of the latchbolt.

2. The vertical door locking system according to claim 1 wherein the latchbolt is manually movable between the latched position and the unlatched position.

3. The vertical door locking system according to claim 1 wherein the latchbolt is slidable between the latched position and the unlatched position.

4. The vertical door locking system according to claim 1 wherein the latch includes a latch body for mounting the latchbolt on the door.

5. The vertical door locking system according to claim 1 wherein the latch body is specially shaped to mount the latchbolt on a corrugated surface of the door.

6. The vertical door locking system according to claim 1 wherein the solenoid rod is spring operated, and the end of the latchbolt and the solenoid rod are shaped to cooperatively interact and drive the solenoid rod towards the retracted position as the latchbolt is moved from the unlatched to the latched position, the spring operated solenoid rod thereafter returning to the extended position and engaging the opening in the end of the latchbolt as the latchbolt reaches the latched position.

7. The vertical door locking system according to claim 6 wherein the end of the latchbolt is beveled to drive the solenoid rod towards the retracted position as the latchbolt is moved from the unlatched to the latched position.

8. The vertical door locking system according to claim 6 wherein the solenoid rod is rounded at an end thereof and cooperatively interacts with the latchbolt to drive the solenoid rod towards the retracted position as the latchbolt is moved from the unlatched to the latched position.

9. The vertical door locking system according to claim 1 wherein the solenoid rod may be manually moved to the retracted position.

10. The vertical door locking system according to claim 9 wherein the solenoid rod includes a knob at an end thereof whereby the solenoid rod may be manually moved to the retracted position.

11. The vertical door locking system according to claim 1 wherein the solenoid mount is adapted for mounting to a guide rail for the vertically opening door.

12. The vertical door locking system according to claim 1 wherein the solenoid mount includes a latchbolt opening for receiving the latchbolt, the latchbolt opening being shaped to steer the latchbolt into a desired alignment relative to the solenoid and the solenoid rod as the latchbolt moves to the latched position.

13. The vertical door locking system according to claim 1 wherein the solenoid rod is weakened to permit the solenoid rod to break when an excess force is applied to the latchbolt whereby the latchbolt may be moved to the unlatched position by breaking the solenoid rod in the event the solenoid fails to operate electrically.

14. A vertical door and vertical door locking system comprising:

a vertically opening door;

a guide rail having a latchbolt opening, the guide rail acting to vertically guide the door between opened and closed positions;

an electrically operable solenoid having a solenoid rod moveable between an extended position and a retracted position;

a latch adapted for attachment to the door, the latch including a latchbolt movable between a latched position to prevent the door from opening and an unlatched position to allow the door to open, the latchbolt having an opening at an end thereof of sufficient size to receive the solenoid rod, the latchbolt extending through the latchbolt opening when the door is in the closed position and the latchbolt is in the latched position; and a solenoid mount attached to the guide rail near the latchbolt opening, the solenoid mount holding the solenoid with the solenoid rod extending perpendicular to the latchbolt, the solenoid rod preventing the latchbolt from moving to the unlatched position when the solenoid rod is in the extended position and received in the opening in the end of the latchbolt.

15. The vertical door and vertical door locking system according to claim 14 wherein the vertical door includes a horizontally corrugated surface and the door is flexible between corrugations.

16. The vertical door and vertical door locking system according to claim 15 wherein the latch includes a specially shaped latch body to mount the latchbolt on the corrugated surface of the door.

17. The vertical door and vertical door locking system according to claim 14 wherein the latchbolt is manually slidable between the latched position and the unlatched position.

18. The vertical door and vertical door locking system according to claim 14 wherein the solenoid rod is spring operated, and the end of the latchbolt and the solenoid rod are shaped to cooperatively interact and drive the solenoid rod towards the retracted position as the latchbolt is moved from the unlatched to the latched position, the spring operated solenoid rod thereafter returning to the extended position and engaging the opening in the end of the latchbolt as the latchbolt reaches the latched position.

19. The vertical door and vertical door locking system according to claim 18 wherein the end of the latchbolt is beveled to drive the solenoid rod towards the retracted position as the latchbolt is moved from the unlatched to the latched position.

20. The vertical door and vertical door locking system according to claim 14 wherein the solenoid mount includes a latchbolt opening for receiving the latchbolt, the latchbolt opening being shaped to steer the latchbolt into a desired alignment relative to the solenoid and the solenoid rod as the latchbolt moves to the latched position.

* * * * *